US005975960A

United States Patent [19]

Fogg et al.

[11] Patent Number: 5,975,960

[45] Date of Patent: Nov. 2, 1999

[54] MODULAR CONNECTOR WITH CAPACITIVE PLATES

[75] Inventors: Michael W. Fogg; John P. Huss, Jr., both of Harrisburg; John M. Landis, Camp Hill; Michael D. Long; Hurley C. Moll, both of Harrisburg, all of Pa.

[73] Assignee: The Whitaker Corporation, Wilmington, Del.

[21] Appl. No.: 09/167,438

[22] Filed: Oct. 6, 1998

[51] Int. Cl.[6] ..... H01R 23/02

[52] U.S. Cl. ..... 439/676; 439/941

[58] Field of Search ..... 439/676, 941

[56] References Cited

U.S. PATENT DOCUMENTS

| | | | |
|---|---|---|---|
| 4,616,893 | 10/1986 | Feldman . | |
| 5,399,106 | 3/1995 | Ferry | 439/620 |
| 5,513,065 | 4/1996 | Caveney et al. | 361/311 |
| 5,702,271 | 12/1997 | Steinman | 439/676 |
| 5,766,043 | 6/1998 | Talend | 439/676 |
| 5,791,943 | 8/1998 | Lo et al. | 439/676 |
| 5,882,214 | 3/1999 | Hillbish | 439/79 |

*Primary Examiner*—Lincoln Donovan
*Assistant Examiner*—J. F. Duverne
*Attorney, Agent, or Firm*—Robert J. Kapalka

[57] ABSTRACT

A connector includes a contact insert (20), first and second contacts (43, 45), and a first plate (30). The contact insert has at least first and second contact channels (58) and at least a first plate receptacle (54) defined therein. The first plate receptacle is proximate the first contact channel and the second contact channel. The first contact is retained in the first contact channel. The second contact is retained in the second contact channel. The first plate (30) is retained in the first plate receptacle (54) to magnetically couple the first contact (43) and the second contact (45).

18 Claims, 5 Drawing Sheets

MODULAR CONNECTOR WITH CAPACITIVE PLATES

BACKGROUND OF THE INVENTION

1. Field of the Invention

This invention relates generally to electrical connectors, and more particularly, to a modular connector with capacitive plates to reduce cross-talk.

2. Description of the Related Art

Modular connectors are widely used to provide electrical connections between devices. For example, modular plugs are typically found on telephone sets to connect the telephone to a modular jack. Modular plug and jack connectors are also commonly used to connect computer equipment.

Cables providing high speed digital signal transmission interfaces between computer equipment typically include a plurality of twisted-pair conductors. Modular connectors used at the ends of the cable are rated for their electrical performance under various operating conditions. The Telecommunications Industry Association and the Electronic Industries Association (TIA/EIA) have issued a telecommunications system bulletin specification entitled, "Additional Transmission Specifications for Unshielded Twisted-Pair connecting Hardware." The specification describes three increasing levels of performance, Category 3, Category 4, and Category 5. Category 5 connectors must meet performance specifications at up to 100 MHz frequencies and 100 Mbps transmission rates.

Industry specifications defining the cable and connector requirements have an inherent defect in the contact vs. twisted-pair arrangement. Some of the wires of the twisted-pair combinations are located in the connector next to other wires from other twisted-pairs. This arrangement increases the amount of cross-talk seen between the competing contacts. This propensity for cross-talk causes problems when trying to meet the Category 5 performance requirements.

Cross-talk can be generally described as the unwanted coupling of electrical signals on adjacent signal lines. Such cross-talk may result in portions of an electrical signal on one pair of lines appearing on a separate pair of lines as unwanted noise. Cross-talk between different pairs of wires is a source of interference that can cause signal degradation and negatively impact the ability of a communication system to process incoming signals. Cross-talk can also increase error rates and reduce signal strength. Problems associated with unwanted cross-talk are becoming even more problematic given the general increase in operating frequencies and data rates of modern communication systems. Additionally, cross-talk can be particularly problematic within electrical connectors that contain a plurality of wires that are generally parallel and spaced closely together. Such a configuration may lead to excessive cross-talk even over short conductor lengths.

Previous methods for reducing the cross-talk have included interleaving the contacts within the connector to cause coupling and reduce the amount of cross-talk. Other techniques have included using a printed-circuit board type capacitive laminate covering the parallel array of contacts. Both techniques involve costly manufacturing methods that become a major contributor to the cost of the connector.

The present invention is directed to overcoming, or at least reducing the effects of, one or more of the problems set forth above.

SUMMARY OF THE INVENTION

An aspect of the present invention is seen in a connector including a contact insert, first and second contacts, and a first plate. The contact insert has at least first and second contact channels and at least a first plate receptacle defined therein. The first plate receptacle is proximate the first contact channel and the second contact channel. The first contact is retained in the first contact channel. The second contact is retained in the second contact channel. The first plate is retained in the first plate receptacle to magnetically couple the first contact and the second contact.

BRIEF DESCRIPTION OF THE DRAWINGS

The invention may be best understood by reference to the following description taken in conjunction with the accompanying drawings, in which like reference numerals identify like elements, and in which:

FIG. 3 is an end view of contacts and a non-ohmic plate of the modular connector of FIG. 1;

Figure 1:
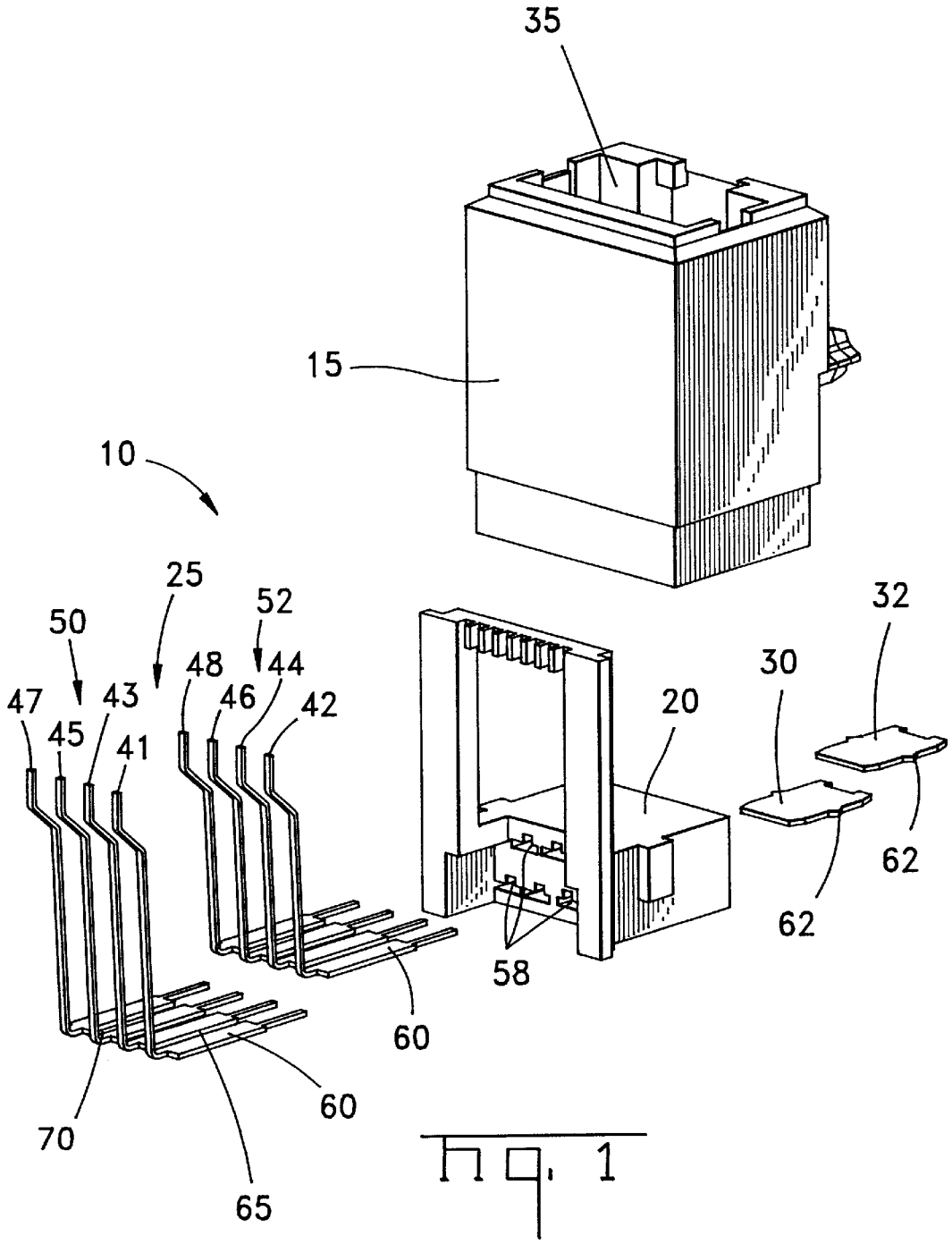
FIG. 1 is an exploded isometric view of a modular connector in accordance with the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring to FIG. 1, an exploded, isometric view of a modular connector assembly 10 in accordance with the present invention is provided. The modular connector assembly 10 includes a housing 15 and a contact insert 20. The contact insert 20 is adapted to receive a plurality of contacts 25 and two non-ohmic plates 30, 32. The housing 15 and contact insert 20 are engageable to form the modular connector assembly 10. The housing 15 includes a plug receptacle 35 adapted to receive an interfacing plug (not shown).

The arrangement of the contorts 25 relative to the corresponding contacts (not shown) of the interfacing plug (not shown) causes a cross-talk problem. The wires (not shown) that ultimately interface with the contacts 25 form twisted pairs. The contacts 25 are individually referred to as contacts 41, 42, 43, 44, 45, 46, 47, and 48. The twisted-pair arrangement, as defined by the specification for the cable (not shown), groups the contacts 41 and 42, the contacts 43 and 46, the contacts 44 and 45, and the contacts 47 and 48 into twisted pairs. Within the contact insert 20, the contacts are arranged with the contacts 41, 43, 45, and 47 in one group 50 and the contacts 42, 44, 46, and 48 in a second group 55. The order of the contacts 25 within the contact insert 20 does not match the twisted-pair arrangement, and as a result the contacts 43 and 45 and the contacts 44 and 46 have an increased propensity for cross-talk.

Assume an electrical signal is driven on contacts 43 and 46. At an initial time, there may be a positive electrical signal on the contact 46 and an equal amplitude, but opposite polarity, negative signal on the contact 43. The contact 46 will couple to the contact 45, resulting in the contact 45 picking up some of the positive signal present on the contact 46. In a similar manner, in the contact 43 will couple to the contact 44, resulting in the contact 44 picking up some of the negative signal present on the contact 43.

Figure 2:
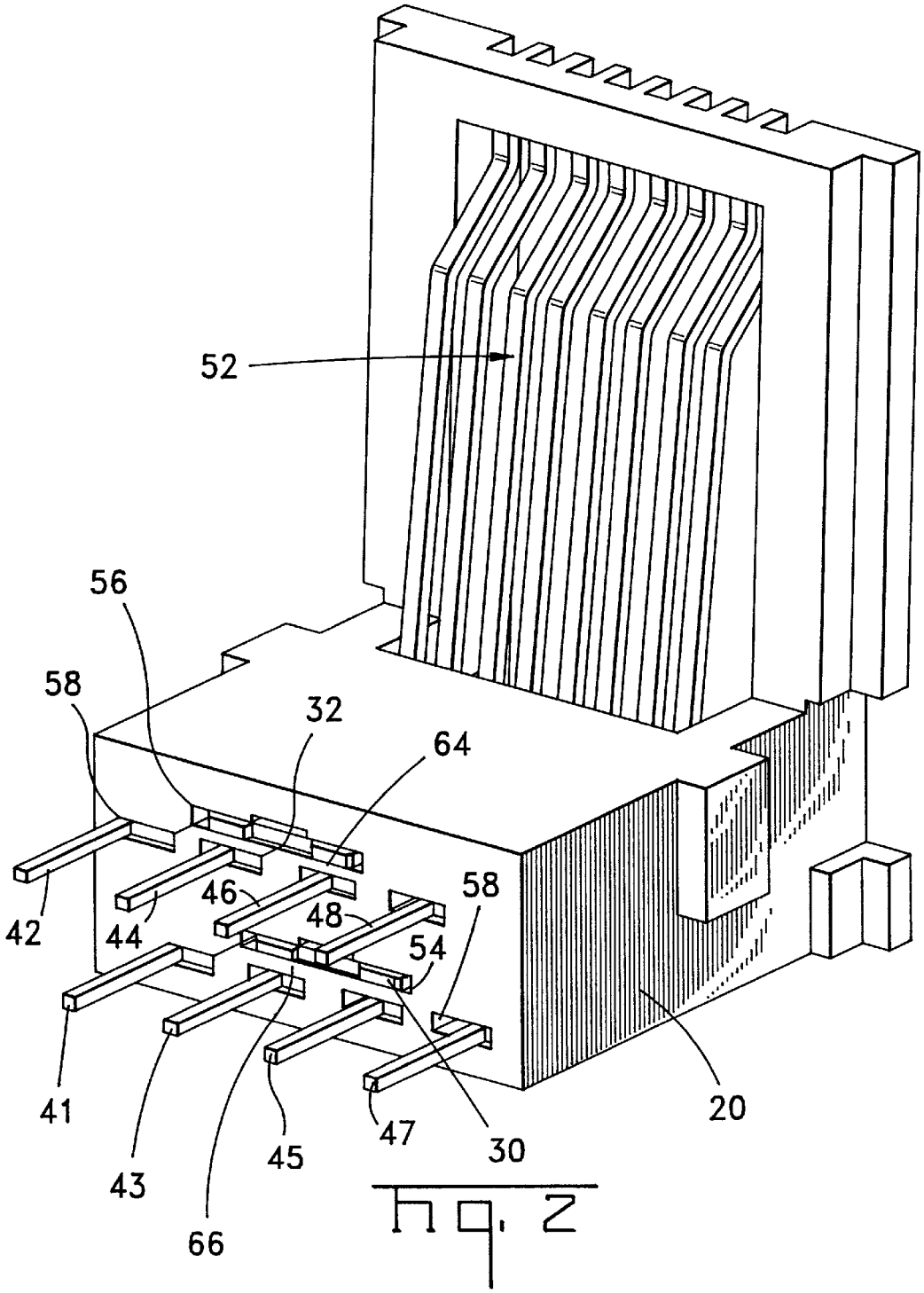
FIG. 2 is an isometric bottom view of a contact insert of the modular connector of FIG. 1.
Figure 7:
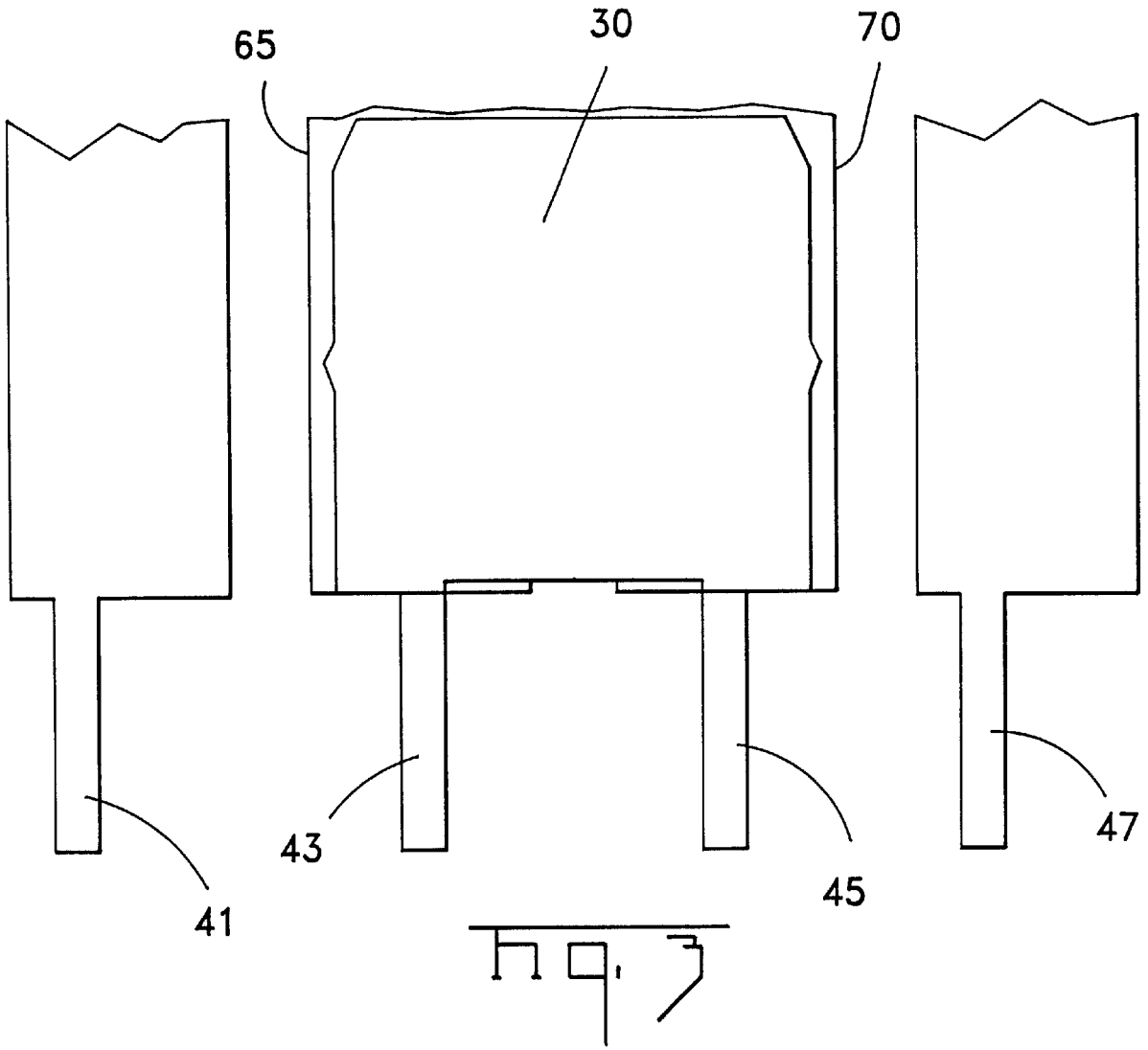

Referring to FIG. 2, and an isometric bottom view of the contact insert 20 is shown. The non-ohmic plates 30, 32 are contained in the contact insert 20 proximate the contacts 43, 45, 44, 46 susceptible to cross-talk. As seen in FIG. 2, plate receptacles 54, 56 are defined in the contact insert 20 for receiving the plates 30, 32. In the illustrated embodiment, the plate receptacles 54, 56 extend only partially through the contact insert 20. Contact channels 58 are defined in the contact insert 20 for receiving the contacts 25. In the illustrated embodiment, the contacts 25 are retained in the contact channels 58 by an interference fit. The contacts 25 include widened tab areas 60 that interface with the contact channels 58 to achieve the interference fit.

The plates 30, 32 are also retained in the plate receptacles 54, 56 by an interference fit. Barbs 62 (shown in FIG. 1) are defined in the plates 30, 32 for enhancing the interference between the plates 30, 32 and the plate receptacles 54, 56. It is also contemplated that the contacts 25 and the plates 30, 32 may be retained in the contact insert 20 by insert molding the contact insert 20 around the contacts 25 and plates 30, 32.

The plate 30 is retained in the plate receptacle 54 proximate the contacts 43, 45, and the plate 32 is retained in the plate receptacle 56 proximate the contacts 44, 46. The portions 64, 66 of the contact insert 20 between the contact insert 20 and the plates 30, 32 act as a dielectric. The plate 30, dielectric portion 64, and contacts 43, 45 form a capacitor that magnetically couples the contacts 43, 45, thereby reducing the cross-talk between the contacts 43, 45. Likewise, the plate 32, dielectric portion 66, and contacts 44, 46 form a capacitor that magnetically couples the contacts 44, 46, thereby reducing the cross-talk between the contacts 44, 46.

The coupling between the contacts 43, 45 results in the contact 45 picking up some of the negative signal present on the contact 43. In turn, this negative signal on the contact 45 acts to cancel or reduce the positive cross-talk signal induced on the contact 45 due to its proximity to the contact 46. Similarly, the coupling between the contacts 44, 46 results in the contact 44 picking up some of the positive signal present on the contact 46. In turn, this positive signal on the contact 44 acts to cancel or reduce the negative cross-talk induced on the contact 44 in the due to is proximity to the contact 43.

Referring briefly to FIG. 3, an end view of the contacts 41, 43, 45, 47 and the plate 30 is provided. For clarity, the contact insert 20 is not shown, however, the contacts 41, 43, 45, 47 and the plate 30 are arranged as they would be located within the contact insert 20. The contact 43 has an outer edge 65 and the contact 45 has an outer edge 70. The width of the plate 30 is slightly smaller than the combined width of the contacts 43, 45 defined between the outer edges 65, 70 when the contacts 43, 45 are mounted in the contact insert 20. This reduces the likelihood that manufacturing tolerances could result in the coupling of contacts 25 other than those described above. A similar relationship exits between the plate 32 and the contacts 44, 46.

In the illustrated embodiment, the contacts 25 are formed of phosphor-bronze, the plates 30, 32 are formed of brass, and the contact insert 20 is formed of liquid crystal polymer.

Figure 4:
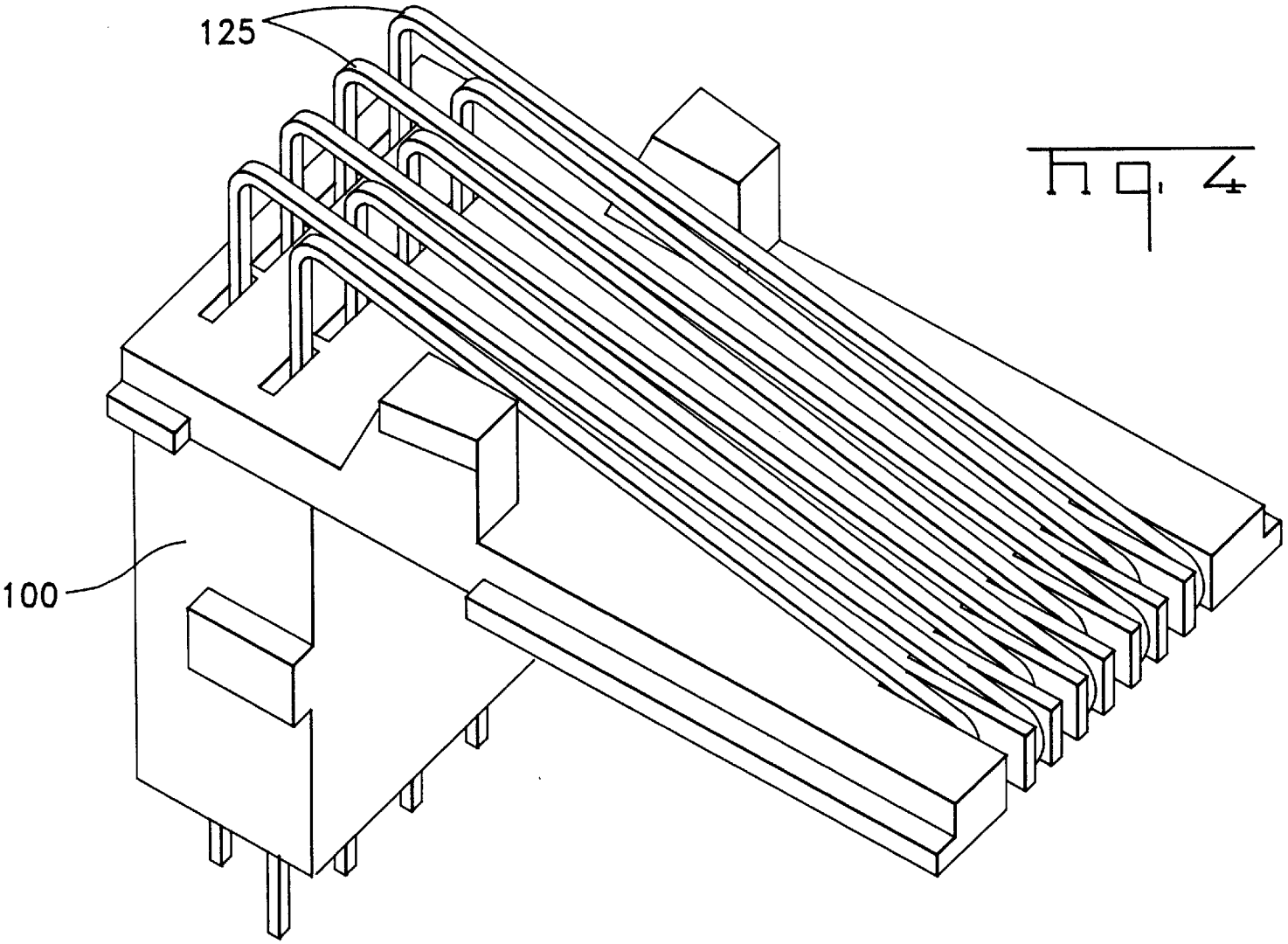
FIG. 4 is an isometric view of an alternative contact insert in accordance with the present invention.
Figure 5:
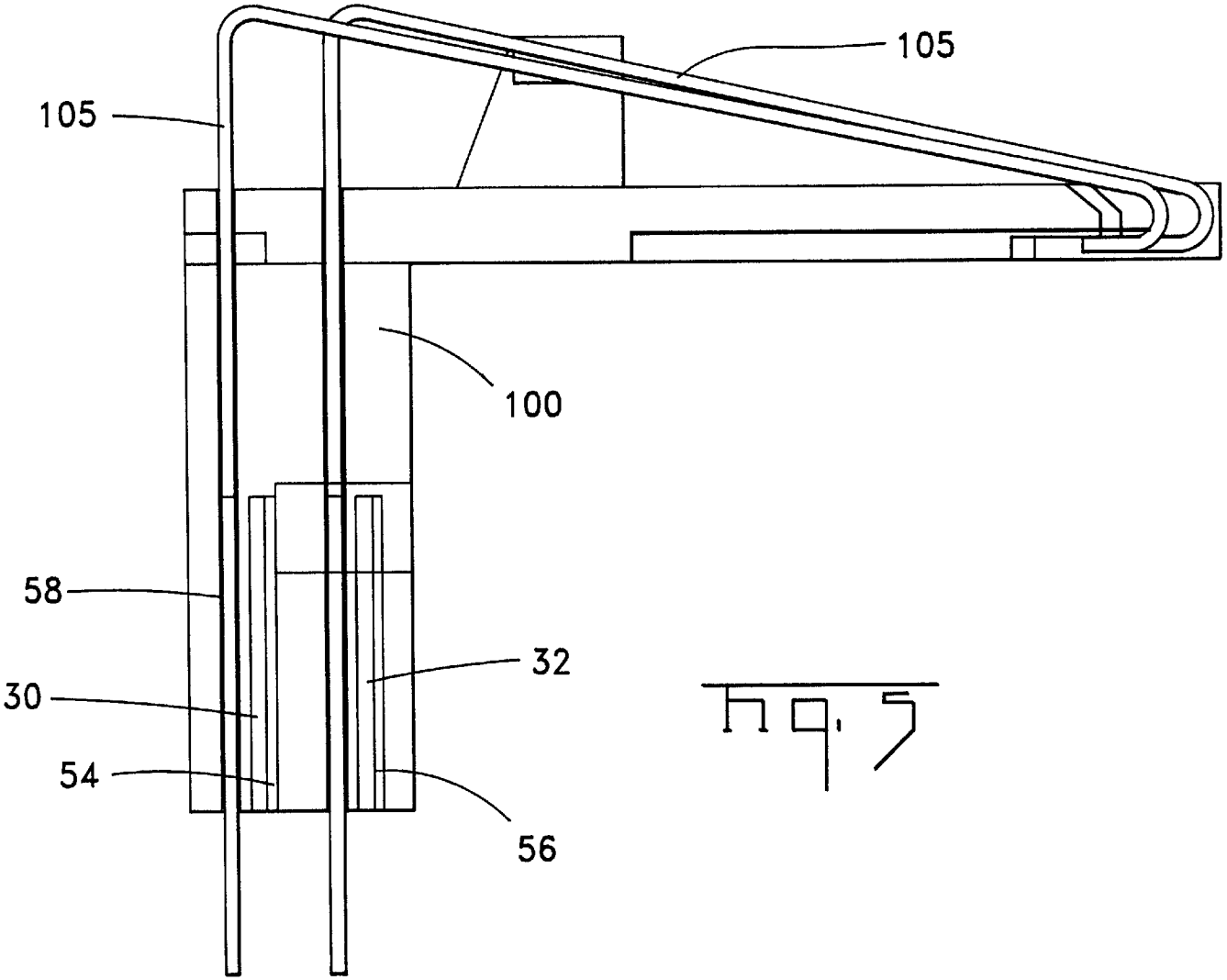
FIG. 5 is a side cross-sectional view of the contact insert of FIG. 3.

FIG. 4 is an isometric view of an alternative contact insert 100 in accordance with the present invention, and FIG. 5 is a side cross-sectional view of the contact insert 100 of FIG. 4. The contact insert 100 is adapted to receive double-supported cantilever contacts 105. The plates 30, 32 are retained in the plate receptacles 54, 56 defined in the contact insert 100 in a similar manner as described above in reference to FIGS. 1 and 2.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A connector, comprising:

a contact insert having at least first and second contact channels and at least a first plate receptacle defined therein, the first plate receptacle being proximate the first contact channel and the second contact channel;

a first contact retained in the first contact channel;

a second contact retained in the second contact channel;

a first plate retained in the first plate receptacle to magnetically couple the first contact and the second contact.

2. The connector of claim 1, further comprising:

a third contact channel defined in the contact insert, the first, second, and third contact channels being arranged in a first row; and a third contact retained in the third contact channel.

3. The connector of claim 1, further comprising:

third and fourth contact channels defined in the contact insert;

a second plate receptacle defined in the contact insert proximate the third and fourth contact channels;

a third contact retained in the third contact channel;

a fourth contact retained in the fourth contact channel;

a second plate retained in the second plate receptacle to magnetically couple the third contact and the fourth contact.

4. The connector of claim 3, wherein the first and second contacts are arranged in a first row, and the third and fourth contacts are arranged in a second row.

5. The connector of claim 4, wherein the first row is essentially parallel to the second row.

6. The connector of claim 3, further comprising:

fifth and sixth contact channels defined in the contact housing, the fifth contact channel being arranged in the first row and the sixth contact channel being arranged in the second row;

a fifth contact retained in the fifth contact channel; and a sixth contact retained in the sixth contact channel.

7. The connector of claim 1, wherein the first contact has a first outer edge, the second contact has a second outer edge, and the first plate has a width less than the distance between the first and second outer edges.

8. The connector of claim 3, wherein the third contact has a first outer edge, the fourth contact has a second outer edge, and the second plate has a width less than the distance between the first and second outer edges.

9. The connector of claim 1, wherein the contact insert includes a first portion between the first and second channels and the plate receptacle, the first portion comprising a dielectric.

10. The connector of claim 1, wherein the contact insert comprises liquid crystal polymer.

11. The connector of claim 1, wherein the first plate comprises brass.

12. A connector, comprising:

a contact insert, comprising:

first and second contact channels arranged in a first row;

third and fourth contact channels arranged in a second row;

a first plate receptacle proximate the first and second contact channels;

a second plate receptacle proximate the third and fourth contact channels;

first, second, third, and fourth contacts retained respective first, second, third, and fourth contact channels;

a first plate retained in the first plate receptacle to magnetically couple the first contact and the second contact; and a second plate retained in the second plate receptacle to magnetically couple the third contact and the fourth contact.

13. The connector of claim 12, further comprising:

fifth and sixth contact channels defined in the contact housing, the fifth contact channel being arranged in the first row and the sixth contact channel being arranged in the second row;

a fifth contact retained in the fifth contact channel; and a sixth contact retained in the sixth contact channel.

14. The connector of claim 12, wherein the first row is essentially parallel to the second row.

15. The connector of claim 12, wherein the first contact has a first outer edge, the second contact has a second outer edge, and the first plate has a width less than the distance between the first and second outer edges.

16. The connector of claim 12, wherein the third contact has a first outer edge, the fourth contact has a second outer edge, and the second plate has a width less than the distance between the first and second outer edges.

17. The connector of claim 1, wherein the contact insert includes a first portion between the first and second channels and the plate receptacle, the first portion comprising a dielectric.

18. The connector of claim 1, wherein the first plate comprises brass.

* * * * *